US009636685B2

(12) United States Patent
Pirttiniemi et al.

(10) Patent No.: US 9,636,685 B2
(45) Date of Patent: May 2, 2017

(54) METHOD AND AN ARRANGEMENT FOR DETERMINING A DEGREE OF FULLNESS OF A LARGE GRINDING MILL DRUM, AND A LARGE GRINDING MILL DRUM

(71) Applicant: OUTOTEC (FINLAND) OY, Espoo (FI)

(72) Inventors: Jukka Pirttiniemi, Helsinki (FI); Esa Porkka, Nurmes (FI); Nikolai Vatanski, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/305,250

(22) PCT Filed: Apr. 27, 2015

(86) PCT No.: PCT/FI2015/050288
§ 371 (c)(1),
(2) Date: Oct. 19, 2016

(87) PCT Pub. No.: WO2015/166140
PCT Pub. Date: Nov. 5, 2015

(65) Prior Publication Data

US 2017/0036213 A1 Feb. 9, 2017

(30) Foreign Application Priority Data

Apr. 28, 2014 (FI) ..... 20145394

(51) Int. Cl.
*B02C 17/22* (2006.01)
*B02C 17/18* (2006.01)
*B02C 25/00* (2006.01)

(52) U.S. Cl.
CPC ..... *B02C 17/1805* (2013.01); *B02C 17/22* (2013.01); *B02C 25/00* (2013.01)

(58) Field of Classification Search
CPC ..... B02C 17/22; B02C 17/1805; B02C 25/00
See application file for complete search history.

(56) References Cited

U.S. PATENT DOCUMENTS 5,360,174 A 11/1994 Persson
6,874,364 B1 4/2005 Campbell et al.
(Continued)

FOREIGN PATENT DOCUMENTS

CL WO 2012080817 A2 * 6/2012 ..... B02C 17/1805
CL WO2012090173 A2 * 7/2012 ..... B02C 17/1805

OTHER PUBLICATIONS

International Search Report issued by the European Patent Office in relation to PCT/FI2015/050288 dated Jul. 15, 2015 (4 pages).
(Continued)

*Primary Examiner* — Mark Rosenbaum
(74) *Attorney, Agent, or Firm* — Robert P. Michal, Esq.; Carter, DeLuca, Farrell & Schmidt, LLP

(57) ABSTRACT

The present invention relates to the field of mineral and metallurgical processes, to disintegrating in general and to disintegrating by tumbling mills, and more particularly to a method and arrangement for determining a degree of fullness of a large grinding mill drum, and to a large grinding mill drum. An arrangement for determining a degree of fullness of a grinding mill drum has a sensor arrangement attached to at least one lifting bar bolt of an at least one lifting bar of the grinding mill. The sensor arrangement includes at least one force transducer attached to the at least one lifting bar bolt. With the help of the measurement arrangement, more reliable measurement data can be provided for the determination of the degree of fullness of a grinding mill drum.

11 Claims, 7 Drawing Sheets

(56) References Cited

U.S. PATENT DOCUMENTS

| | | | |
|---|---|---|---|
| 7,699,249 | B2 | 4/2010 | Jarvinen |
| 2004/0256505 | A1 | 12/2004 | De Haas |

OTHER PUBLICATIONS

Written Opinion of the International Searching Authority issued by the European Patent Office in relation to PCT/FI2015/050288 dated Jul. 15, 2015 (8 pages).

* cited by examiner

METHOD AND AN ARRANGEMENT FOR DETERMINING A DEGREE OF FULLNESS OF A LARGE GRINDING MILL DRUM, AND A LARGE GRINDING MILL DRUM

CROSS-REFERENCE TO RELATED APPLICATIONS

This application is a National Phase Entry under 35 USC §371 of PCT Patent Application Serial No. PCT/FI2015/050288 filed Apr. 27, 2015, which claims the benefit under 35 USC §119(e) to Finnish Patent Application No. 20145394, filed Apr. 28, 2014, the disclosure of each of these applications are expressly incorporated herein by reference in their entireties.

FIELD OF THE INVENTION

The present invention relates to the field of mineral and metallurgical processes, to disintegrating in general and to disintegrating by tumbling mills, and more particularly to a method and arrangement for determining a degree of fullness of a large grinding mill drum, and to a large grinding mill drum.

BACKGROUND OF THE INVENTION

One of the most common processes in mining and metallurgy is the comminution processing or disintegrating of ore. When processing material for the selective or collective recovery of valuable material components, the processes concerned are preceded by comminution processing i.e. mechanical crushing or disintegration of the material in a manner to free the valuable components, one from the other. Comminution is particle size reduction of materials. Comminution is achieved by blasting, crushing and grinding. After comminution the components are then mutually isolated with the aid of known separation methods, this isolation being contingent on differences in color, shape, density or in differences in their respective surface active and magnetic properties, or other properties.

In comminution processing first ore or rock is excavated, broken down or removed by blasting. Blasting is the controlled use of explosives and other methods in mining, quarrying and civil engineering. Typically blasting produces particles in the size having a diameter of 500 mm or more.

Crushing is particle size reduction of ore or rock materials by using crushing devices i.e. crushers. Crushers e.g. jaw crushers, gyratory crushers or cone crushers are used to reduce the size, or change the form, of materials so that pieces of different composition can be differentiated. In the crushing process the crushing devices hold material being crushed between two parallel or tangent solid surfaces of a stronger material and apply sufficient force to bring said surfaces together. Typically in a crushing process particles having a diameter up to 1000 mm are crushed to particles having a diameter of 5 mm or more.

Grinding is particle size reduction of ore or rock materials in grinding mills. In hard rock mining and industrial mineral operations the demands for rotating mineral and metallurgical processing equipment such as grinding mills are very high both in terms of grinding efficiency and energy consumption. Typically in a grinding process particles having a diameter up to 1000 mm are grinded to particles having a diameter of 0.010 mm or more. This conventional grinding of materials results in considerable wear on the grinding bodies present in the mill, due to the hardness of the rock concerned, therewith also resulting in considerable costs for the provision of such grinding bodies.

The rotating mineral and metallurgical processing equipment such as grinding mills are typically very large, having a diameter of several meters. The grinding mills may be trunnion-supported or shell-supported. Trunnion support is the most common way of supporting a mill in a mineral processing application, especially in very large grinding mills. In a bearing arrangement of a trunnion-supported grinding mill the support bearings have a relatively small bearing diameter and the trunnion journals have a high consistent stiff journal surfaces, this facilitating the formation of a good bearing lubricant film distribution. The shell-supported grinding mills are more compact, occupy less floor space and require simpler foundations than comparable trunnion-supported grinding mills. Because the end plates of the shell-supported grinding mill do not support the structure, the feed and discharge openings may be sized to meet process conditions without being constrained by trunnion bearing limitations.

A ball mill is a typical type of fine grinder. However, the rotating mineral and metallurgical grinding mills are today very often autogenous grinding mills or semi-autogenous grinding mills designed for grinding or primary crushed ore. Autogenous grinding mills are so-called due to the self-grinding of the ore. In an autogenous grinding mill a rotating drum throws larger rocks of ore in a cascading motion which causes impact breakage of larger rocks and compressive grinding of finer particles. In autogenous grinding the actual material itself, i.e. the material to be ground, forms the grinding bodies.

Semi-autogenous grinding mills are similar to autogenous mills, but utilize grinding balls e.g. steel grinding balls to aid in grinding like in a ball mill. Attrition between grinding balls and ore particles causes grinding of finer particles. Semi-autogenous grinding mills typically use a grinding ball charge of 8 to 21%, sometimes a grinding ball charge of 5 to 60%. A semi-autogenous grinding mill is generally used as a primary or first stage grinding solution. Semi-autogenous grinding mills are primarily used at gold, copper and platinum mines with applications also in the lead, zinc, silver, alumina and nickel industries.

Autogenous and semi-autogenous grinding mills are characterized by their large diameter and short length as compared to ball mills. The rotating mineral and metallurgical processing equipment such as autogenous and semi-autogenous grinding mills are typically driven by ring gears, with a 360° fully enclosing guard.

The inside of an autogenous or semi-autogenous grinding mill is lined with mill linings. The mill lining materials typically include cast steel, cast iron, solid rubber, rubber-steel composites or ceramics. The mill linings include lifters, e.g. lifter bars to lift the material inside the mill, where it then falls off the lifters onto the rest of the ore charge.

Rotating mineral and metallurgical processing equipment that is provided with internal lifters is typically difficult to control. For example, in autogenous grinding mills or semi-autogenous grinding mills the feed to the mill also acts as a grinding media, and changes in the feed have a strong effect on the grinding efficiency. The change in the feed properties is a normal phenomenon that needs to be considered in controlling the rotating mineral and metallurgical processing equipment.

In autogenous or semi-autogenous grinding mills, the existing mineral deposits seldom have a homogenous structure and a homogenous mechanical strength. Material properties such as hardness, particle size, density and ore type also change constantly and consequently a varying energy input is required.

Conventionally grinding has been controlled on the basis of the mill power draw, but particularly in autogenous and semi-autogenous grinding, the power draw is extremely sensitive to changes in feed parameters. It has been discovered that the degree of fullness in the mill as percentages of the mill volume is a quantity that is remarkably more stable and much more descriptive as regards the state of the mill. But because the degree of fullness is difficult to infer in an on-line-measurement, the measurement of the load mass is often considered sufficient. However, the mass measurement has its own problems both in installation and in measurement drift. Moreover, there may be intensive variations in the load density, in which case changes in the mass do not necessarily result from changes in the degree of fullness.

As a summary, the degree of fullness is an important parameter that describes the state of the grinding mill. The main challenge with the degree of the fullness is that the parameter is difficult to measure online. One prior art method for determining the degree of fullness of a large grinding mill drum has been to measure the weight of a large grinding mill drum and use the measured weight to calculate the degree of fullness of a large grinding mill drum. In this prior art method the weight of the grinding charge has been used as the deciding parameter for controlling the mill. This method is cost demanding, however, because of the weighing equipment needed to register continuously the changes in the weight of the grinding charge that occur during operation of the mill, which enables the steps necessary in order to improve prevailing operating conditions to be carried out as quickly as possible. Also the water content of the mill changes constantly, the density, hardness and particle size of the grinding charge changes constantly. Furthermore the mill linings typically constitute up to 30-50% of total weight of the mill. As these linings wear off in time this has a considerable effect on the weight of the mill. Therefore the weight of the grinding mill drum is not a good indication the degree of fullness in the grinding mill drum. All in all it has been discovered that the weight of the grinding charge does not correlate good enough with the degree of fullness in the grinding mill drum as percentages of mill volume.

Another prior art method for determining the degree of fullness of a large grinding mill drum has been to measure and analyze the power consumption or the power intake signal of a large grinding mill and use the measured power consumption to calculate the degree of fullness of a large grinding mill drum. However, particularly in autogenous and semi-autogenous grinding mills, the power consumption is extremely sensitive to changing parameters. The energy or power requirement of a large grinding mill depends on several factors, such as the density of the grinding charge, a mill constant, the extent of mill charge replenishment, or the instant volume of charge in the grinding mill, relative mill speed, length and diameter of the grinding mill. Furthermore, it has been discovered that the grinding mill power consumption or the power intake signal does not correlate enough with the degree of fullness in the grinding mill drum as percentages of mill volume.

The above presented two prior art methods are off-shell-device type methods for determining the degree of fullness of a large grinding mill drum. That is, the measuring devices are installed on the side of the grinding mill on the surrounding structure. A third off-shell-device type prior art method for determining the degree of fullness of a large grinding mill drum has been to measure acoustic wave properties of a large grinding mill and use the measured acoustic wave properties, i.e. sound pressure and/or sound intensity to estimate the degree of fullness of a large grinding mill drum. In the third prior art method the off-shell-device type acoustic wave property measurement sensors may be a single microphone or a series of microphones or microphone mats that are measuring acoustic wave properties coming from the large grinding mill. Also here, it has been discovered that the off-shell-device measured grinding mill acoustic wave properties provide only a rough estimate on the degree of fullness.

In the following, the prior art will be described with reference to the accompanying FIG. 1, which shows a cross-sectional view of a large grinding mill drum according to the prior art.

FIG. 1 shows a cross-sectional view of a large grinding mill drum according to the prior art. In FIG. 1 the grinding mill has a drum casing 1, which drum casing 1 is provided with linings. The linings of the drum casing 1 comprise lifting bars 2, which lifting bars 2 lift the grinding charge material inside the mill, where it then falls off the lifting bars 2 onto the rest of the grinding charge. The angle in which the grinding charge material inside the mill first hits a lifting bar 2 is called "toe angle" $\phi_k$. Respectively the angle in which the grinding charge material inside the mill first falls off a lifting bar 2 is called "shoulder angle" $\phi_s$.

Over the recent years there has also been a lot of development around on-mill-shell type of devices. In U.S. Pat. No. 6,874,364 a system for monitoring mechanical waves from a moving machine has been presented in which system a sensor arrangement is located on an exterior surface of the grinding mill drum. The presented sensor arrangement has an acoustic wave sensor for measuring acoustic wave properties and an accelerometer for measuring mechanical waves, i.e. vibrational events and low frequency events, event spatial localization, and events occurring on the ends of the mill. The presented mechanical wave monitoring method may also include a step of monitoring volumetric load in the machine based on the measured mechanical waves. However, even the presented on-mill-shell type device measured grinding mill acoustic wave properties do not correlate adequately enough with the degree of fullness in the grinding mill drum as percentages of mill volume.

In U.S. Pat. No. 5,360,174 an arrangement for registering the instant grinding charge volume of a grinding drum has been presented in which arrangement there is integrated a tension sensor on a flexible bar inside a rubber or steel-cap lifter bar of the grinding mill drum. In the U.S. Pat. No. 5,360,174 patent specification there is in FIG. 1 presented a point A where a lifting device will engage the grinding charge, said point A also commonly referred to a toe position or toe angle. Similarly in FIG. 1 of said patent specification there is presented a point B where a lifting device will leave its engagement with the grinding charge, said point B also commonly referred to a shoulder position or shoulder angle. The tension sensor arrangement presented in the U.S. Pat. No. 5,360,174 patent specification detects a tension on a lifter bar caused by the grinding charge load. However, the presented tension sensor arrangement requires customized lifter bars of the grinding mill drum.

In U.S. Pat. No. 7,699,249 there is presented a method for defining the degree of fullness in a mill is calculated on the basis of the measured toe angle, the rotation speed of the mill and the geometrical dimensions of the mill. However, the presented sensor arrangement does not consistently enough provide straightforward and adequate measurement sensitivity required for a precise monitoring of the degree of fullness in the grinding mill drum as percentages of mill volume.

In general, there are some problems with the prior art solutions for measuring the degree of fullness of a large grinding mill drum. So far, the measuring solutions are relatively complex and difficult in order to provide reliable information. Also the measurement accuracy and reliability with the prior art measuring solutions has not been adequate enough.

The problem therefore is to find a solution for measuring the degree of fullness of a large grinding mill drum which can provide reliable measurement data for the determination of the degree of fullness of a large grinding mill drum with better measurement accuracy and reliability.

There is a demand in the market for a method for determining a degree of fullness of a large grinding mill drum which method would be more reliable and have a better measurement sensitivity when compared to the prior art solutions. Likewise, there is a demand in the market for an arrangement for determining a degree of fullness of a large grinding mill drum which arrangement would be more reliable and have a better measurement sensitivity when compared to the prior art solutions; and also a demand for a large grinding mill drum having such characteristics.

BRIEF DESCRIPTION OF THE INVENTION

An object of the present invention is thus to provide a method and an apparatus for implementing the method so as to overcome the above problems and to alleviate the above disadvantages.

The objects of the invention are achieved by a method for determining a degree of fullness of a large grinding mill drum which method comprises the steps of:

measuring force measurement data from reactions caused by the grinding material, said reactions subjected to an at least one lifting bar and to an at least one lifting bar bolt of the grinding mill, using at least one force transducer attached to said at least one lifting bar bolt; and calculating the degree of fullness of the grinding mill from said force measurement data.

Preferably, in the step of measuring also position/angle measurement data on the position and/or the angle or rotation of the at least one lifting bar bolt of the grinding mill, using at least one accelerometer) and/or inclinometer attached to or arranged next to said at least one lifting bar bolt; and that in the step of calculating also said position/angle measurement data is utilized.

Alternatively, in the step of calculating a toe angle $\phi_k$ and/or a shoulder angle $\phi_s$ of the grinding mill drum is first calculated.

Furthermore, the objects of the invention are achieved by an arrangement for determining a degree of fullness of a large grinding mill drum, having a sensor arrangement attached to at least one lifting bar bolt of an at least one lifting bar of the grinding mill, said sensor arrangement having an at least one force transducer attached to said at least one lifting bar bolt.

Preferably, said sensor arrangement has an at least one accelerometer and/or inclinometer attached to said at least one lifting bar bolt. Alternatively, said sensor arrangement has an at least one accelerometer and/or inclinometer arranged next to said at least one lifting bar bolt.

Further preferably, said arrangement further comprises:

a data processing and transmitting unit arranged on the grinding mill drum casing surface, said data processing and transmitting unit connected to said sensor arrangement;

a data receiving unit arranged outside the mill drum on any fixed surrounding structure outside the mill drum; and a data processing device.

Preferably, said data processing and transmitting unit comprises a signal acquisition module for receiving the measurement signals from the sensor arrangement and a transmitter for transmitting the measurement data wirelessly to said data receiving unit. Preferably, said data processing and transmitting unit comprises a relay for switching the data processing and transmitting unit on wirelessly. Preferably, said data processing and transmitting unit further comprises a power supply and/or a regulator and/or an amplifier.

Preferably, said sensor arrangement is attached to one lifting bar bolt on the grinding mill drum casing surface. Alternatively, said several sensor arrangements are attached to the several lifting bar bolts in one row on the grinding mill drum casing surface. Alternatively, said several sensor arrangements are attached to the several lifting bar bolts in several rows on the grinding mill drum casing surface.

Furthermore, the objects of the invention are achieved by a large grinding mill drum, which comprises an arrangement for determining a degree of fullness of a large grinding mill drum, having a sensor arrangement attached to at least one lifting bar bolt of an at least one lifting bar of the grinding mill, said sensor arrangement having an at least one force transducer attached to said at least one lifting bar bolt.

Figure 1:
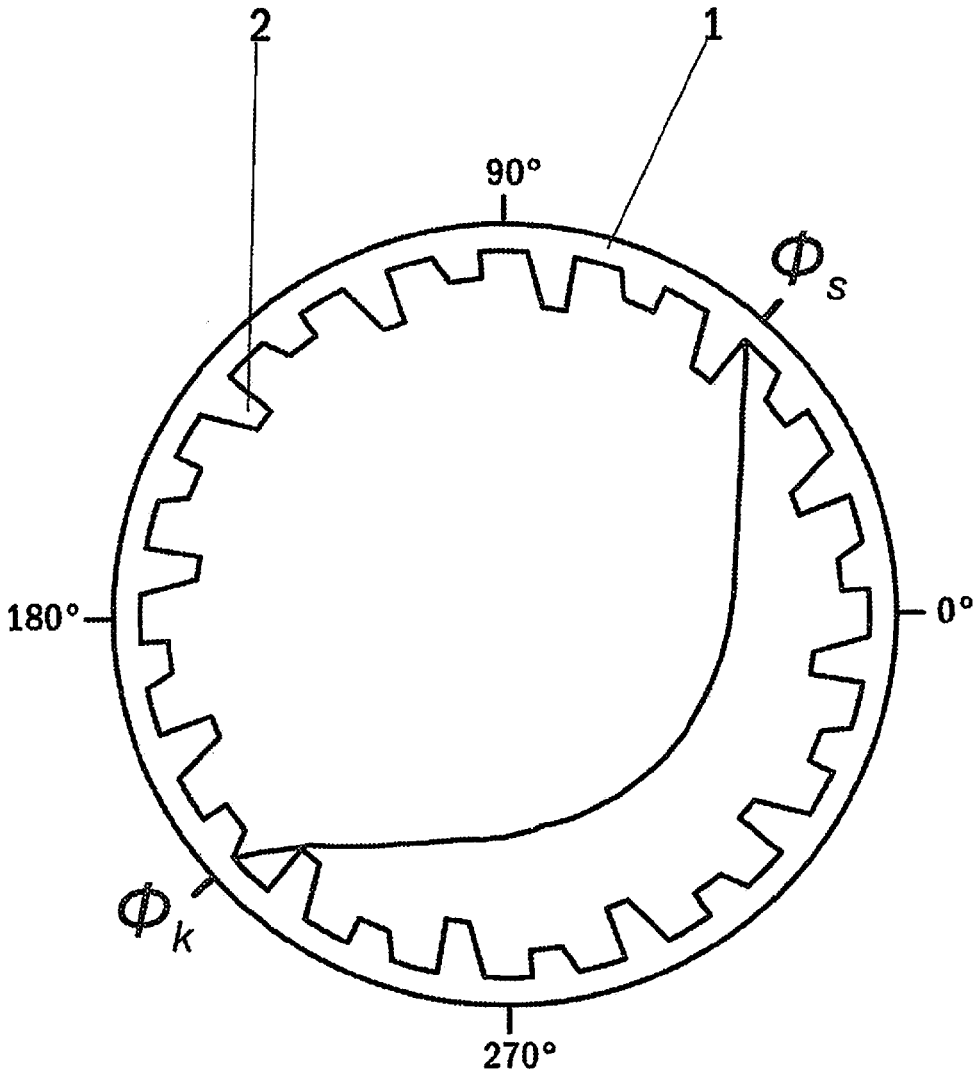
FIG. 1 shows a cross-sectional view of a large grinding mill drum according to the prior art.

The prior art drawing of FIG. 1 has been presented earlier. In the following, the invention will be described in greater detail by means of preferred embodiments with reference to the accompanying drawings of FIGS. 2 to 7.

DETAILED DESCRIPTION OF THE INVENTION

The present invention relates to a method and an arrangement for registering the instant volume or the instant level of the charge in an ore-grinding drum of the kind that is provided with internal lifting means.

Figure 2:
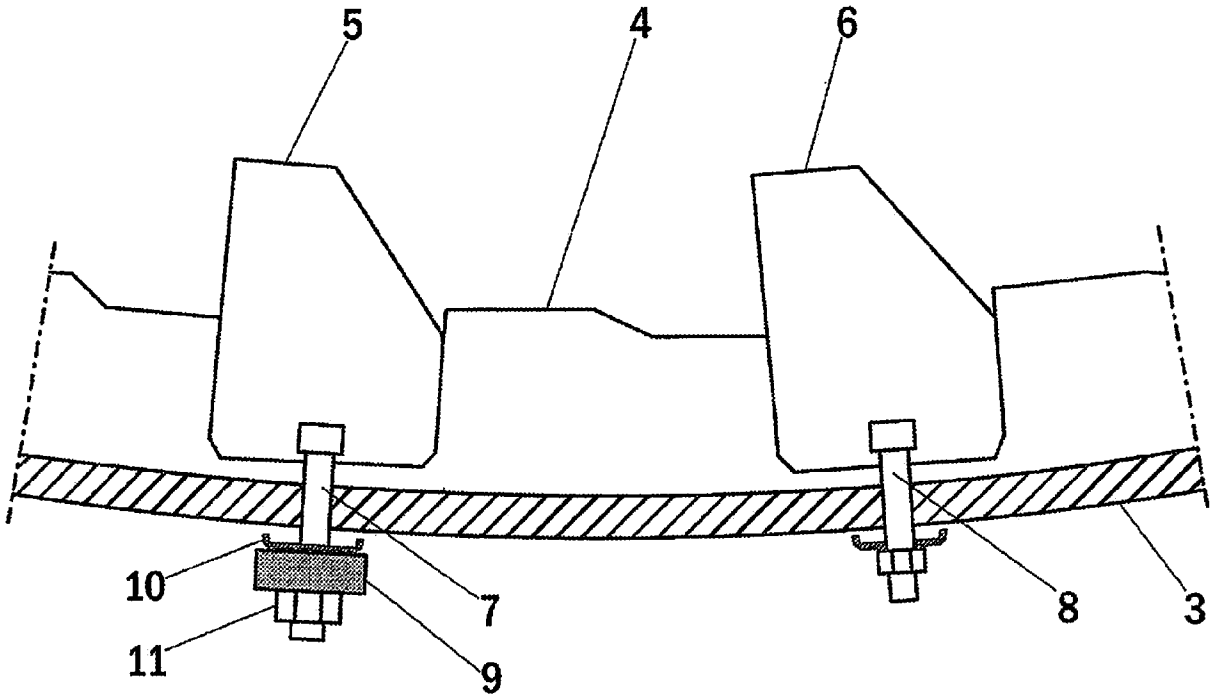
FIG. 2 shows a partial cross-sectional view of a one embodiment of an arrangement for determining a degree of fullness of a large grinding mill drum according to the present invention.

FIG. 2 shows a partial cross-sectional view of a one embodiment of an arrangement for determining a degree of fullness of a large grinding mill drum according to the present invention. In FIG. 2 the grinding mill has a drum casing 3, which drum casing 3 is provided with linings 4. The linings 4 of the drum casing 3 comprise lifting bars 5, 6, which lifting bars 5, 6 have been attached to the drum casing 3 of the grinding mill with lifting bar bolts 7, 8.

In the presented embodiment of an arrangement for determining a degree of fullness of a large grinding mill drum according to the present invention said determining arrangement has at least one lifting bar bolt 7, which has been provided with a force transducer 9. In the presented embodiment of a determining arrangement said force transducer 9 has been attached to the said at least one lifting bar bolt 7 with the help of a shim 10 and a nut 11. The force transducer 9 is used to measure reactions caused by the grinding material said reactions subjected to the lifting bar 5 and to the said at least one lifting bar bolt 7 of the grinding mill. The determining arrangement according to the presented embodiment of the present invention may also have an accelerometer and/or an inclinometer arranged next to the said at least one lifting bar bolt 7 of the grinding mill.

Figure 3:
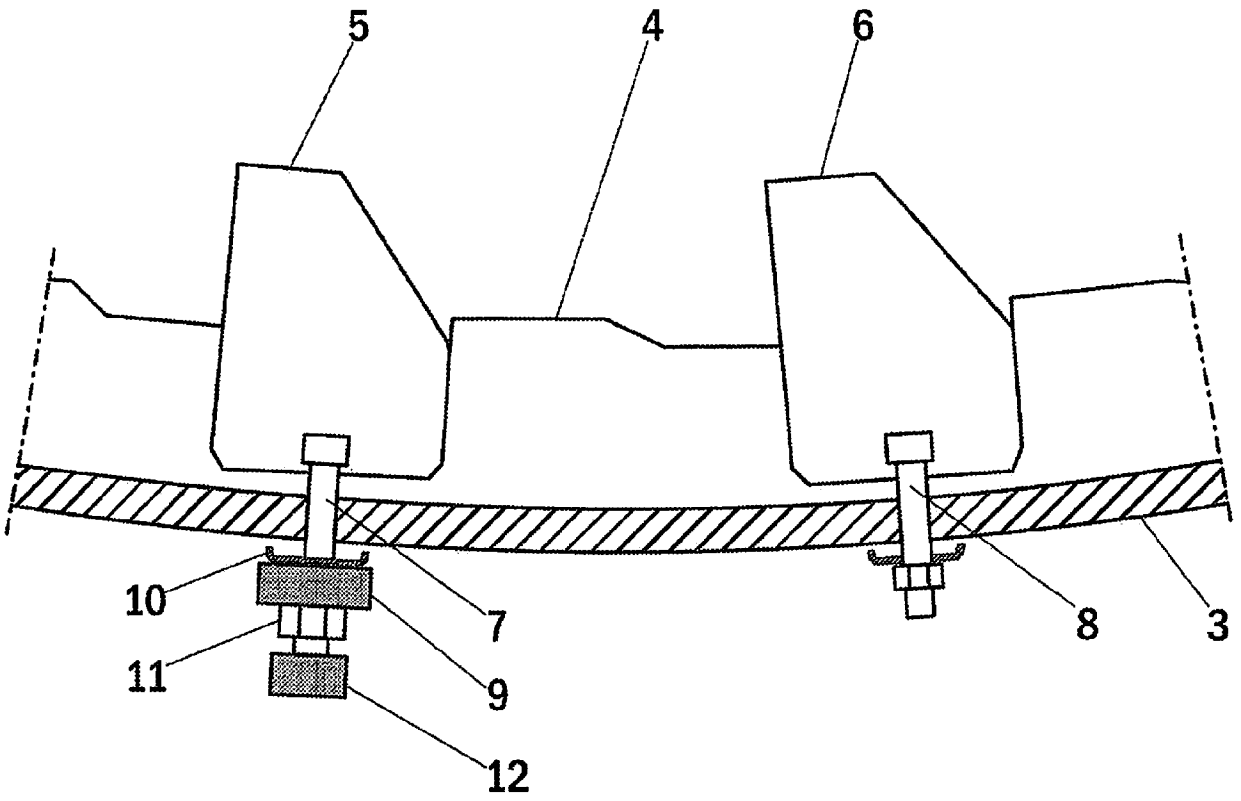
FIG. 3 shows a partial cross-sectional view of a another embodiment of an arrangement for determining a degree of fullness of a large grinding mill drum according to the present invention.

FIG. 3 shows a partial cross-sectional view of another embodiment of an arrangement for determining a degree of fullness of a large grinding mill drum according to the present invention. In FIG. 3 the grinding mill has a drum casing 3, which drum casing 3 is provided with linings 4. The linings 4 of the drum casing 3 comprise lifting bars 5, 6, which lifting bars 5, 6 have been attached to the drum casing 3 of the grinding mill with lifting bar bolts 7, 8.

In the presented another embodiment of an arrangement for determining a degree of fullness of a large grinding mill drum according to the present invention said determining arrangement has an at least one lifting bar bolt 7, which has been provided with a force transducer 9 and an accelerometer 12 and/or an inclinometer. In the presented another embodiment of a determining arrangement said force transducer 9 has been attached to the said at least one lifting bar bolt 7 with the help of a shim 10 and a nut 11. Furthermore in the presented another embodiment of a determining arrangement said accelerometer 12 and/or inclinometer has been attached to the said at least one lifting bar bolt 7.

The force transducer 9 is used to measure reactions caused by the grinding material to the lifting bar 5 and to the said at least one lifting bar bolt 7 of the grinding mill. The accelerometer 12 and/or inclinometer is used to measure the position and the angle or rotation of the said at least one lifting bar bolt 7 of the grinding mill and of the force transducer 9 attached to the said at least one lifting bar bolt 7. The accelerometer 12 and/or inclinometer is used to synchronize the output of the force transducer 9 to the mill rotation and to define the phase angle of the lifting bar with respect to the earth gravity.

Figure 4:
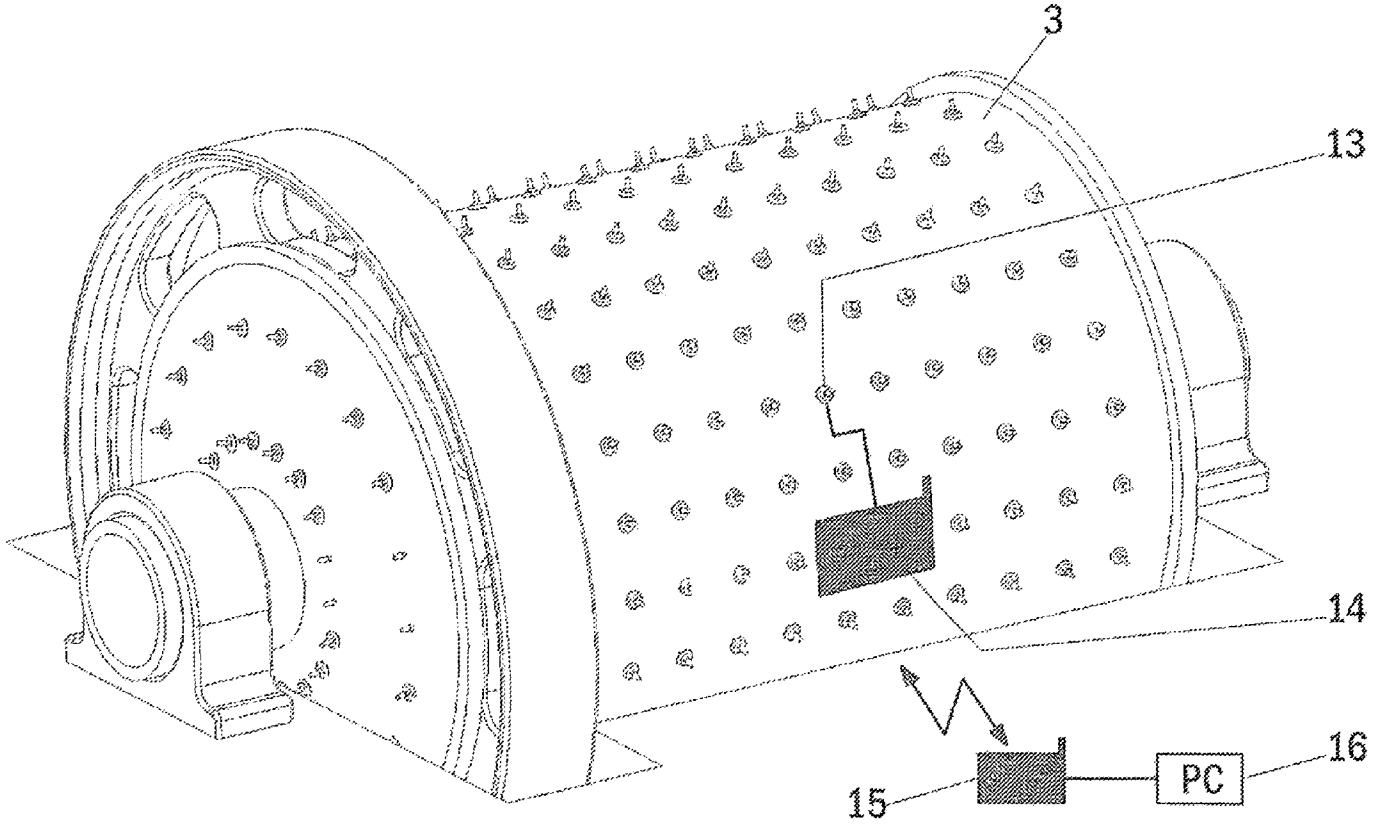
FIG. 4 shows a perspective view of a third embodiment of an arrangement for determining a degree of fullness of a large grinding mill drum according to the present invention.

FIG. 4 shows a perspective view of a third embodiment of an arrangement for determining a degree of fullness of a large grinding mill drum according to the present invention. The third embodiment of a determining arrangement comprises a sensor arrangement 13 attached to one lifting bar bolt on the grinding mill drum casing surface 3 and a data processing and transmitting unit 14 arranged on the grinding mill drum casing surface 3, said data processing and transmitting unit 14 connected to said sensor arrangement 13. Said data processing and transmitting unit 14 may also be attached to the one or more lifting bar bolts on the grinding mill drum casing surface 3. Furthermore the third embodiment of a determining arrangement comprises a data receiving unit 15 and a data processing device 16, e.g. a personal computer (PC) 16, said data receiving unit 15 and said data processing device 16 being arranged outside the mill drum on any fixed surrounding structure outside the mill drum. The data processing and transmitting unit 14 is responsible for handling raw measurement signals obtained from the sensor arrangement 13, and transmitting those wirelessly to the data receiving unit 15 and further to the data processing device 16. With apparatus having a sensor arrangement 13 consisting of one force transducer and one accelerometer it is possible to measure the degree of fullness in one mill cross section.

Figure 5:
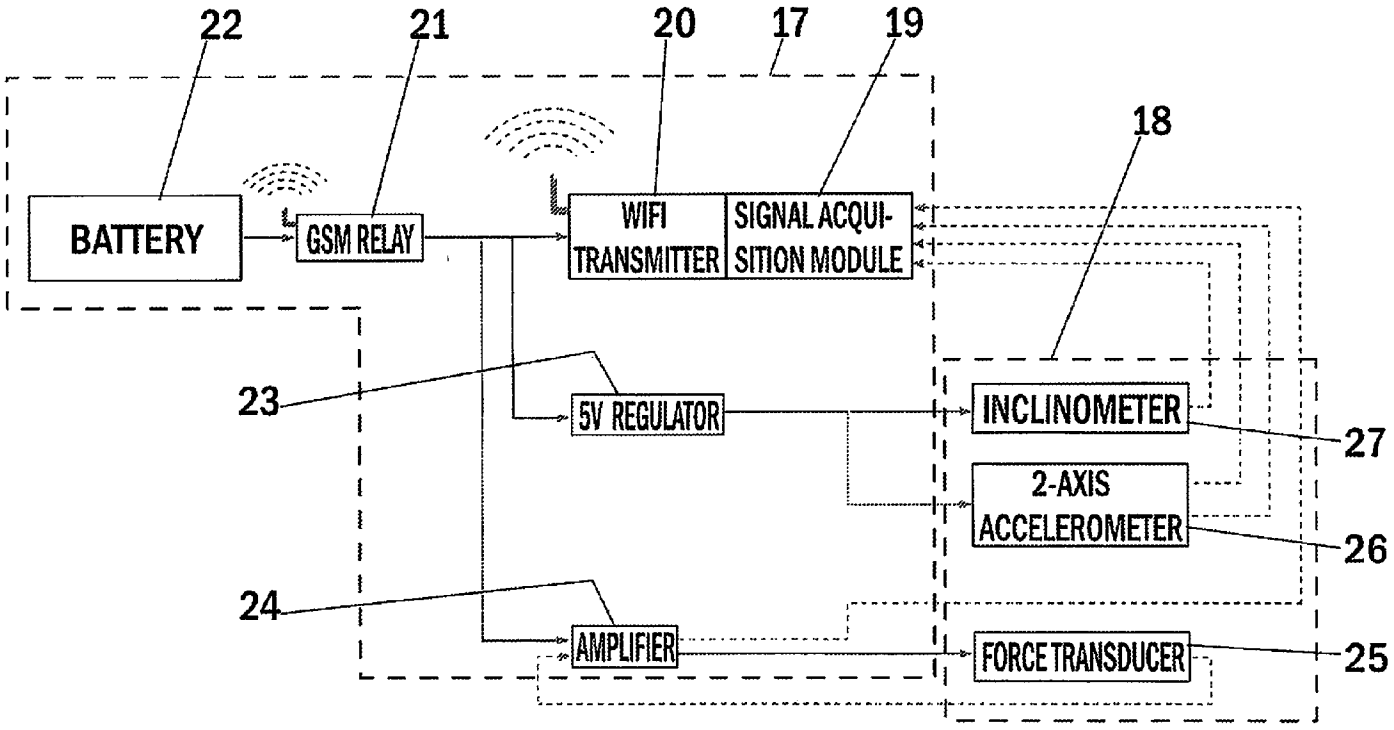
FIG. 5 shows a schematic diagram of one embodiment of an arrangement for determining a degree of fullness of a large grinding mill drum according to the present invention.

FIG. 5 shows a schematic diagram of one embodiment of an arrangement for determining a degree of fullness of a large grinding mill drum according to the present invention. The one embodiment of a determining arrangement shown in FIG. 5 comprises a data processing and transmitting unit 17 arranged on the grinding mill drum surface and a sensor arrangement 18 attached to the said at least one lifting bar bolt on the grinding mill drum surface.

The data processing and transmitting unit 17 of the determining arrangement according to an embodiment of the present invention comprises a signal acquisition module 19 for receiving the measurement signals from the a sensor arrangement 18; a transmitter 20 for transmitting the measurement data wirelessly to a data receiving unit 15 arranged outside the mill drum on any fixed surrounding structure outside the mill drum; and a relay 21 for switching the data processing and transmitting unit 17 on wirelessly.

The data processing and transmitting unit 17 of the determining arrangement according to an embodiment of the present invention may also comprise a power supply 22 for providing electrical power to the determining arrangement; a regulator 23 for providing regulated voltage to the sensor arrangement 18; and an amplifier 24 for providing regulated power to a force transducer 25 of the sensor arrangement 18 and amplifying the signal from said force transducer 25 of the sensor arrangement 18 to a signal acquisition module.

The sensor arrangement 18 of the determining arrangement according to an embodiment of the present invention comprises a force transducer 25 for measuring reactions caused by the grinding material to a lifting bar bolt of the grinding mill; and an accelerometer 26 and an inclinometer 27 for measuring the position and the angle or rotation of a lifting bar bolt of the grinding mill and of the force transducer 25 attached to the said lifting bar bolt. The accelerometer 26 and an inclinometer 27 is used to synchronize the output of the force transducer 25 to the mill rotation and to define the phase angle of the lifting bar with respect to the earth gravity. The force transducer 25 may be any kind of force transducer 25 suitable for measuring reactions on a lifting bar bolt such as e.g. a strain gage type transducer. The accelerometer 26 may be any kind of accelerometer 26 suitable for measuring the position and the angle or rotation of a lifting bar bolt such as e.g. a capacitive accelerometer. The force transducer 25 may also be based on a force sensor, on a pressure sensor, on a strain gauge or on a piezoelectric sensor.

Figure 6:
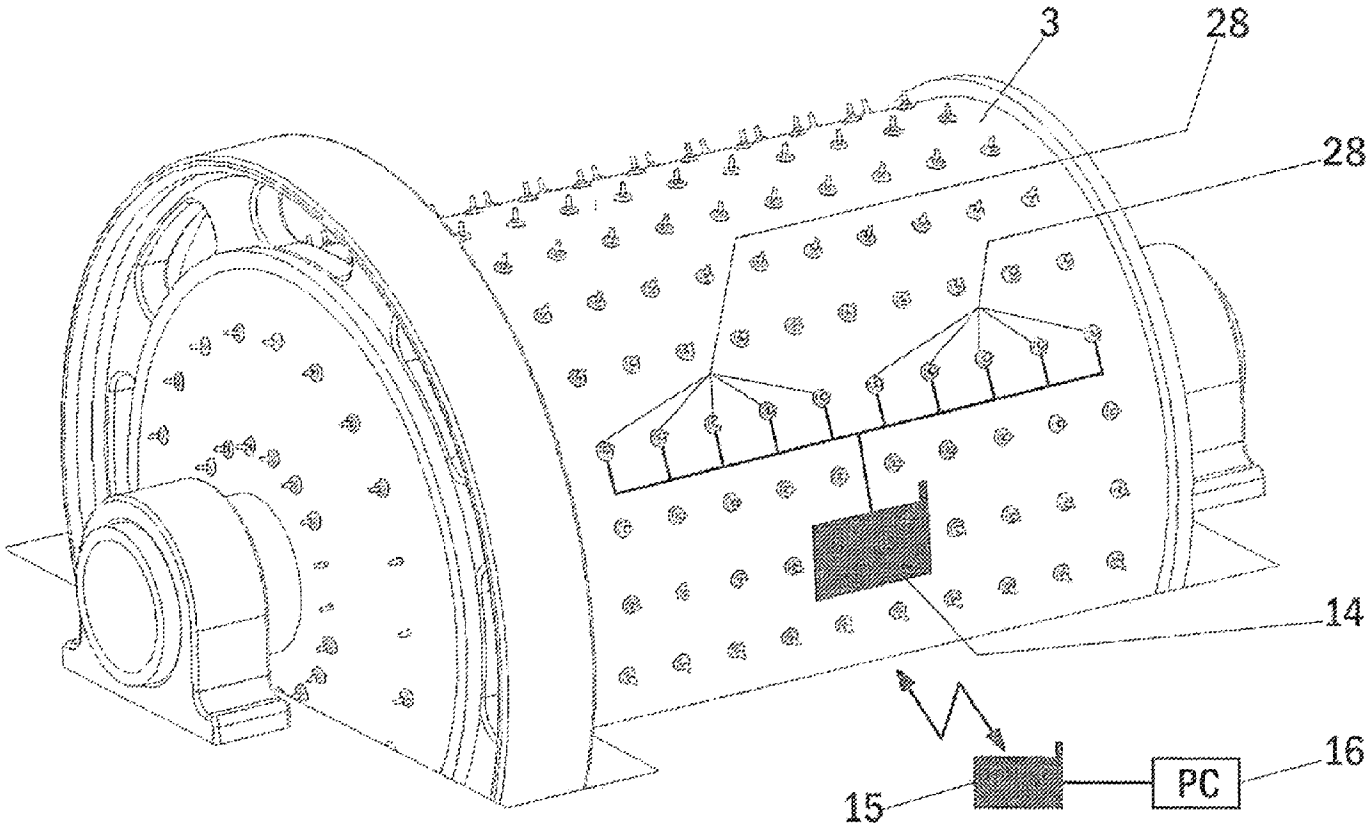
FIG. 6 shows a perspective view of a fourth embodiment of an arrangement for determining a degree of fullness of a large grinding mill drum according to the present invention.

FIG. 6 shows a perspective view of a fourth embodiment of an arrangement for determining a degree of fullness of a large grinding mill drum according to the present invention. The fourth embodiment of a determining arrangement comprises several sensor arrangements 28 attached to the several lifting bar bolts in one row on the grinding mill drum casing surface 3 and a data processing and transmitting unit 14 arranged on the grinding mill drum casing surface 3, said data processing and transmitting unit 14 connected to said several sensor arrangements 28. Said data processing and transmitting unit 14 may also be attached to the one or more lifting bar bolts on the grinding mill drum casing surface 3. Furthermore the fourth embodiment of a determining arrangement comprises a data receiving unit 15 and a data processing device 16, e.g. a personal computer (PC) 16, said data receiving unit 15 and said data processing device 16 being arranged outside the mill drum on any fixed surrounding structure outside the mill drum. The data processing and transmitting unit 14 is responsible for handling raw measurement signals obtained from the sensor arrangements 28, and transmitting those wirelessly to the data receiving unit 15 and further to the data processing device 16. With apparatus having several sensor arrangements 28 consisting of several force transducers and several accelerometers it is possible to measure the degree of fullness in several mill cross sections. In addition an apparatus with several force transducers and several accelerometers becomes more reliable.

Figure 7:
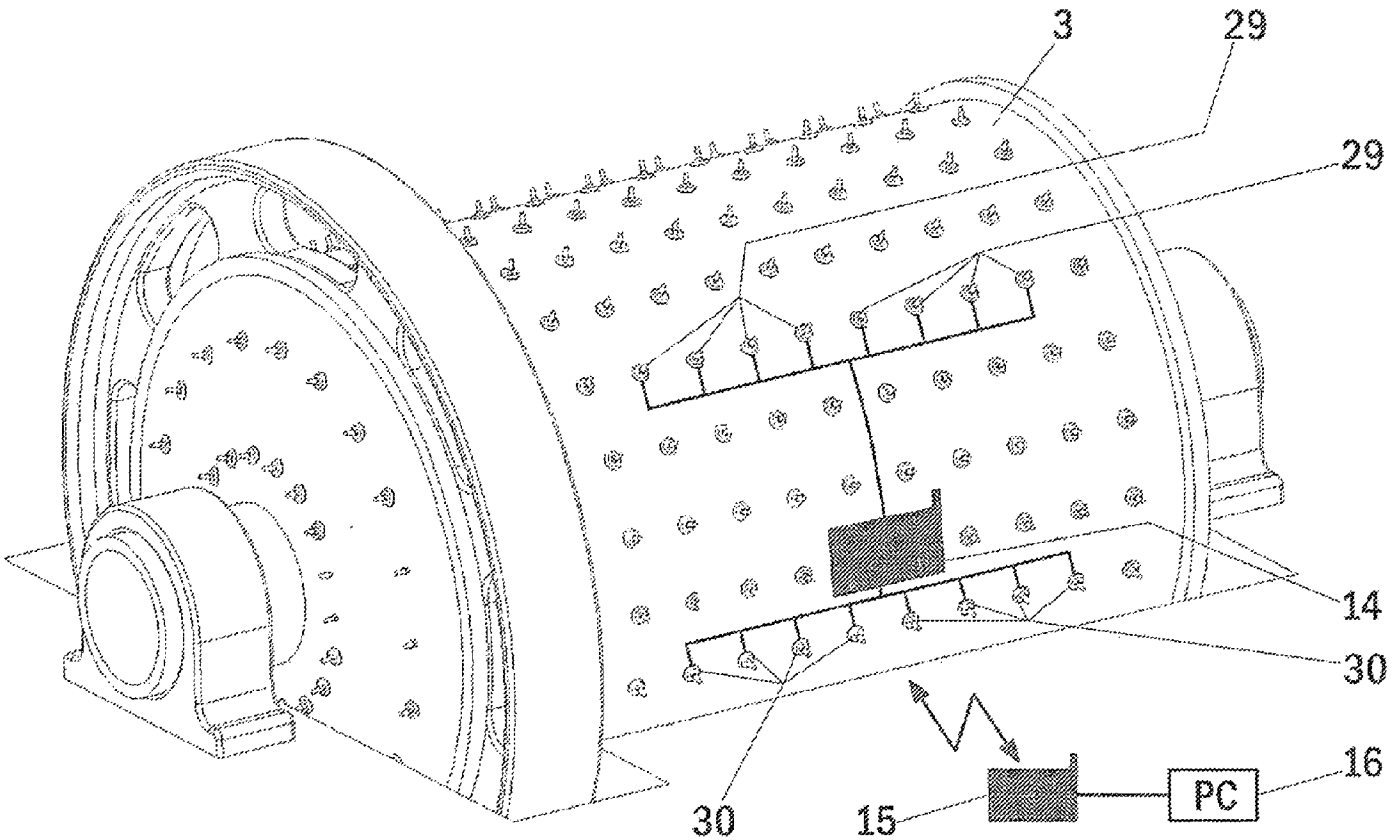
FIG. 7 shows a perspective view of a fifth embodiment of an arrangement for determining a degree of fullness of a large grinding mill drum according to the present invention.

FIG. 7 shows a perspective view of a fifth embodiment of an arrangement for determining a degree of fullness of a large grinding mill drum according to the present invention. The fifth embodiment of a determining arrangement comprises several sensor arrangements 29, 30 attached to the several lifting bar bolts in several rows on the grinding mill drum casing surface 3 and a data processing and transmitting unit 14 arranged on the grinding mill drum casing surface 3, said data processing and transmitting unit 14 connected to said several sensor arrangements 29, 30. Said data processing and transmitting unit 14 may also be attached to the one or more lifting bar bolts on the grinding mill drum casing surface 3. Furthermore the fifth embodiment of a determining arrangement comprises a data receiving unit 15 and a data processing device 16, e.g. a personal computer (PC) 16, said data receiving unit 15 and said data processing device 16 being arranged outside the mill drum on any fixed surrounding structure outside the mill drum. The data processing and transmitting unit 14 is responsible for handling raw measurement signals obtained from the sensor arrangements 29, 30, and transmitting those wirelessly to the data receiving unit 15 and further to the data processing device 16. With apparatus having several sensor arrangements 29, 30 consisting of several force transducers and several accelerometers it is possible to provide a three dimensional picture of the conditions and the state inside the grinding mill. In addition an apparatus with several force transducers and several accelerometers becomes more reliable.

In the method and arrangement for determining a degree of fullness of a large grinding mill drum according to the present invention there is measured force measurement data on reactions caused by the grinding material to an at least one lifting bar bolt of the grinding mill as well as measurement data on the position and the angle or rotation of the at least one lifting bar bolt of the grinding mill. With the help of this force measurement data the degree of fullness of a large grinding mill is then calculated. In this calculation there can be the toe angle $\phi_k$ and/or the shoulder angle $\phi_s$ first calculated.

In the method and arrangement according to the present invention the degree of fullness of a large grinding mill may be calculated e.g. as explained in the following and also disclosed in U.S. Pat. No. 7,699,249 B2. In the analysis of the measurement results the phase θ of the force or power oscillation caused by the lifter bars is calculated by using a sample data P(n) that is equidistant in relation to the angle of rotation and is obtained e.g. on the basis of the mill power draw of one rotation cycle, according to the following formula:

$$\theta = \arg\left[\sum_{n=0}^{N-1} P(n)\exp\left(\frac{-2\pi i n N_n}{N}\right)\right]$$

where $i=\sqrt{-1}$=imaginary unit $$\arg z = \arctan\frac{\operatorname{Im} z}{\operatorname{Re} z} = \text{the polar angle,}$$

i.e. argument, of a complex number z,

N=number of samples in a sample data P(n), $N_n$=number of lifter bars in the mill, n=number of sample, and θ=the phase of the oscillation caused by the lifter bars.

The toe angle is calculated from the phase θ of the power oscillation caused by the lifter bars as follows, according to the following formula:

$$\Phi_k = \frac{2\pi(k_n + 1) - \theta}{N_n} + \Phi_n$$

where $k_n$=number of lifter bars, remaining in between the lifter bar located nearest to the axis x and the lifter bar located nearest to the toe position, $\phi_k$=toe angle, and $\phi_n$=angle from the axis x to the lifter bar located nearest to the axis x, so that it has a positive value in the rotation direction of the mill.

The degree of fullness is calculated from the toe angle and the rotation speed of the mill by means of various mathematical models, such as the model defined in the Julius Kruttschitt Mineral Research Center (JKMRC). Said model is described in more detail for example in the book Napier-Munn, T., Morrell, S., Morrison, R., Kojovic, T.: Mineral Comminution Circuits, Their Operation and Optimisation (Julius Kruttschnitt Mineral Research Centre, University of Queensland, Indooroopilly, Australia, 1999). The calculation formula of the JKMRC model for the degree of fullness in a mill is given in the following formula:

$$\begin{cases} n_{c,i+1} = 0,35(3,364 - V_i) \\ V_{i+1} = 1,2796 - \dfrac{\Phi_{toe} - \dfrac{\pi}{2}}{2,5307\left(1 - e^{-19,42(n_{c,i+1} - n_p)}\right)} \end{cases},$$

where the degree of fullness is defined by iterating the degree of fullness of the mill in relation to the interior volume of the mill. In the above formula, $n_c$ is an experimentally calculated portion of the critical speed of the mill, in which case centrifugation is complete, $n_p$ is the rotation speed of the mill in relation to the critical speed, $V_i$ is the previous degree of fullness of the mill, and $V_{i+1}$ is the degree of fullness to be defined, in relation to the interior volume of the mill.

The solution for determining a degree of fullness of a large grinding mill drum according to the present invention provides a direct measurement of the reactions caused by the grinding material. The degree of fullness of the grinding mill drum can therefore be determined irrespective of possible stops and interruptions. With the help of the arrangement according to the present invention consisting of several force transducers and several accelerometers it is possible to provide a three dimensional image of the conditions inside the grinding mill.

As the measurement according to the present invention is a direct measurement of the phenomena and related measurement of the reactions caused by the grinding material, there is no need for calibration. As the position and the angle of the sensors are continuously known online there is no need for external trigger to determine the rotation. This is of particular importance in the analysis and calculation, as this simplifies calculations substantially and makes the result more reliable. As the measurement solution with sensor arrangements is quite simple and straightforward also installation and maintenance is easy.

With the help of the solution according to the present invention the manufacturers of large grinding mill drums will be able to provide grinding mill with a measurement arrangement producing more reliable measurement data for the determination of the degree of fullness of a large grinding mill drum with said measurement arrangement having better measurement sensitivity. The solution according to the present invention may be utilised in any kind of large grinding mill having lifter bars inside the grinding mill drum.

It will be obvious to a person skilled in the art that, as the technology advances, the inventive concept can be implemented in various ways. The invention and its embodiments are not limited to the examples described above but may vary within the scope of the claims.

The invention claimed is:

1. An arrangement for determining a degree of fullness of a grinding mill drum, comprising a sensor arrangement coupled to at least one lifting bar bolt of an at least one lifting bar of a grinding mill, said sensor arrangement having at least one force transducer coupled to the at least one lifting bar bolt.

2. The arrangement according to claim 1, wherein said sensor arrangement comprises at least one of an accelerometer and inclinometer coupled to said at least one lifting bar bolt.

3. The arrangement according to claim 1, wherein said sensor arrangement comprises at least one of an accelerometer and inclinometer disposed next to said at least one lifting bar bolt.

4. The arrangement according to claim 1, said arrangement further comprising:

a data processing and transmitting unit disposed on the grinding mill drum casing surface, said data processing and transmitting unit being operatively coupled to said sensor arrangement;

a data receiving unit disposed outside the mill drum on a fixed surrounding structure outside the mill drum; and a data processing device.

5. The arrangement according to claim 4, wherein said data processing and transmitting unit comprises a signal acquisition module for receiving the measurement signals from the sensor arrangement and a transmitter for transmitting the measurement data wirelessly to said data receiving unit.

6. The arrangement according to claim 4 wherein said data processing and transmitting unit comprises a relay wirelessly actuating the data processing and transmitting unit.

7. The arrangement according to claim 4, wherein said data processing and transmitting unit further comprises at least one of a power supply, a regulator, and an amplifier.

8. The arrangement according to claim 1, wherein said sensor arrangement is attached to at least one lifting bar bolt on the grinding mill drum casing surface.

9. The arrangement according to claim 1, wherein several sensor arrangements are attached to several lifting bar bolts in one row on the grinding mill drum casing surface.

10. The arrangement according to claim 1, wherein several sensor arrangements are attached to several lifting bar bolts in several rows on the grinding mill drum casing surface.

11. A grinding mill drum, wherein said grinding mill drum comprises an arrangement for determining a degree of fullness of the grinding mill drum according to claim 1.

* * * * *